US008155555B2

(12) United States Patent
Funada

(10) Patent No.: US 8,155,555 B2
(45) Date of Patent: Apr. 10, 2012

(54) DEVELOPER DELIVERING DEVICE AND IMAGE FORMING APPARATUS

(75) Inventor: Atsushi Funada, Kanagawa (JP)

(73) Assignee: Fuji Xerox Co., Ltd, Tokyo (JP)

( * ) Notice: Subject to any disclaimer, the term of this patent is extended or adjusted under 35 U.S.C. 154(b) by 116 days.

(21) Appl. No.: 12/818,818

(22) Filed: Jun. 18, 2010

(65) Prior Publication Data

US 2011/0064474 A1 Mar. 17, 2011

(30) Foreign Application Priority Data

Sep. 17, 2009 (JP) ..... 2009-215993

(51) Int. Cl.
*G03G 15/08* (2006.01)

(52) U.S. Cl. ..... 399/102; 399/258

(58) Field of Classification Search ..... 399/98, 399/102, 103, 258, 259
See application file for complete search history.

(56) References Cited

U.S. PATENT DOCUMENTS

2006/0285885 A1 12/2006 Lee

FOREIGN PATENT DOCUMENTS

JP 2000-221766 A 8/2000

OTHER PUBLICATIONS

Extended European Search Report dated Apr. 27, 2011, in Application No. 10167706.0.

*Primary Examiner* — Mark R Gaworecki
(74) *Attorney, Agent, or Firm* — Sughrue Mion, PLLC

(57) ABSTRACT

A powder transporting device includes a transporting path that has first and second transporting path transporting paths, a connecting member that is disposed in a connecting portion of the first transporting path and the second transporting path, a sealing member that seals a connection transporting path and the connecting member; an opening that is disposed on an end side of the connection transporting path of the connecting member; a rotation gate member that moves between a rotation blocking position and a rotation opening position; and an outer gate member moves between an outer opening position and an outer blocking position.

6 Claims, 8 Drawing Sheets

DEVELOPER DELIVERING DEVICE AND IMAGE FORMING APPARATUS

CROSS-REFERENCE TO RELATED APPLICATION

This application is based on and claims priority under 35 USC 119 from Japanese Patent Application No. 2009-215993 filed on Sep. 17, 2009.

BACKGROUND

Technical Field

The present invention relates to a powder transporting device and an image forming apparatus.

SUMMARY

According to an aspect of the invention, a powder transporting device includes:

a transporting path that has a first transporting path in which a powder is transported and a second transporting path connected to the first transporting path, the first transporting path and the second transporting path being relatively removable;

a connecting member that is disposed in a connecting portion of the first transporting path and the second transporting path so as to be supported on one of the first transporting path and the second transporting path;

a sealing member that is supported on an end of a connection transporting path on the other of the first transporting path and the second transporting path which is connected to the connecting member and that seals the connection transporting path and the connecting member when the connection transporting path and the connecting member are connected to each other;

an opening that is disposed on an end side of the connection transporting path of the connecting member;

a rotation gate member that is supported rotatably around a rotating center disposed on a side of the sealing member of the opening and that moves between (i) a rotation blocking position in which the opening is blocked and (ii) a rotation opening position in which the opening is opened and which is inclined toward an inner part side of the connection transporting path;

an outer gate member that is disposed on an outside of the rotation gate member moved to the rotation blocking position so as to be supported on the connecting member movably in a direction along the opening and;

wherein the sealing member moves the rotation gate member from the rotation opening position to the rotation blocking position while contacting an external surface of the rotation gate member when the connection transporting path is moved in a separating direction from the connecting member, and the outer gate member moves between (iii) an outer opening position in which an outside of the rotation gate member is opened in contact with the sealing member when the connection transporting path and the connecting member are connected to each other and (iv) an outer blocking position in which the outside of the rotation gate member is blocked when the connection transporting path is separated from the connecting member.

BRIEF DESCRIPTION OF THE DRAWINGS

Embodiments of the invention will be described in detail based on the following figures, wherein.

DETAILED DESCRIPTION

Figure 1:
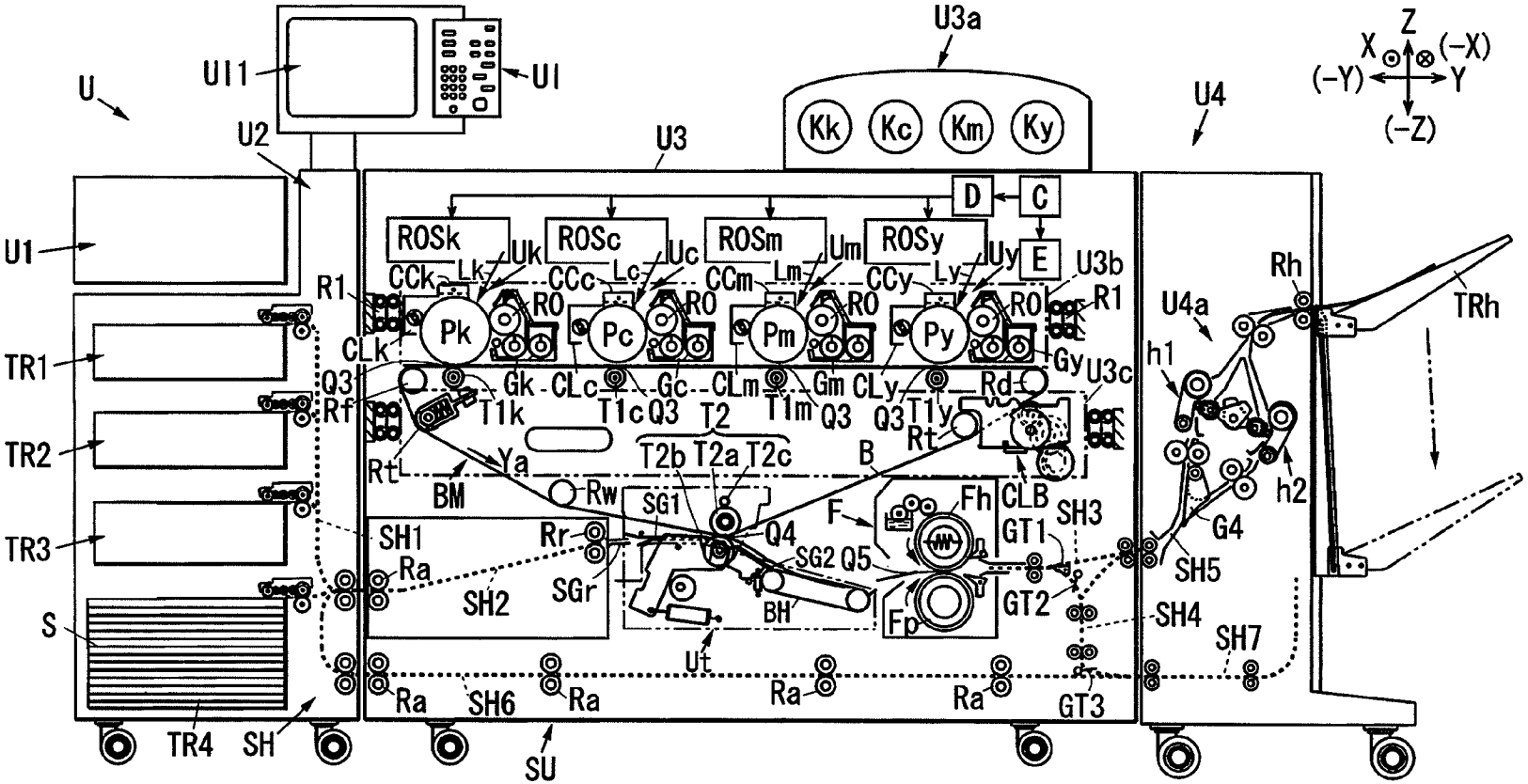
FIG. 1 is an explanatory view showing a whole image forming apparatus according to a first example of the invention.

Next, a specific example (hereinafter referred to as an example) according to an exemplary embodiment of the invention will be described with reference to the drawings, and the invention is not restricted to the following example.

For easy understanding of the following description, in the drawings, a longitudinal direction is set to be an X-axis direction, a transverse direction is set to be a Y-axis direction, a vertical direction is set to be a Z-axis direction, and directions or sides indicated as arrows X, −X, Y, −Y, Z and −Z are set to be forward, rearward, rightward, leftward, upward and downward directions or front, rear, right, left, upper and lower sides, respectively.

In the drawings, moreover, it is assumed that a circle having "•" described therein implies an arrow turned from a back side of a paper toward a right side thereof, and a circle having "X" described therein implies an arrow turned from the right side of the paper to the back side thereof.

In the following description using the drawings, an illustration of members other than necessary members for explanation will be properly omitted for easy understanding.

First Example

FIG. 1 is an explanatory view showing a whole image forming apparatus according to a first example of the invention.

In FIG. 1, an image forming apparatus U has a user interface UI according to an example of an operating portion, an image input device U1 according to an example of an image information input device, a paper feeding device U2, an image forming apparatus body U3, and a paper processing device U4.

The user interface UI has input keys according to an example of input buttons such as a copy start key according to an example of a copy start button, a copy number set key according to an example of a copy number set button, and a numerical keypad according to an example of a numeral input button, and a display unit UI1.

The image input device U1 is constituted by an image scanner according to an example of an automatic original transporting device and an image reading device. In FIG. 1, the image input device U1 reads an original which is not shown and converts the original into image information, and inputs the image information to the image forming apparatus body U3.

The paper feeding device U2 has paper feeding trays TR1 to TR4 according to an example of plural of paper feeding portions, and a paper feeding path SH1 for taking out a recording paper S according to an example of a medium which is accommodated in each of the paper feeding trays TR1 to TR4 and transporting the recording paper S to the image forming apparatus body U3.

In FIG. 1, the image forming apparatus body U3 has an image recording portion for recording an image on the recording paper S transported from the paper feeding device U2, a toner dispenser device U3*a* according to an example of a multicolor powder supplying device, a paper transporting path SH2, a paper discharging path SH3, a paper inverting path SH4 and a paper circulating path SH6. The image recording portion will be described below.

Moreover, the image forming apparatus body U3 has a control portion C, a laser driving circuit D according to an example of a latent image writing device driving circuit which is to be controlled by the control portion C, and a power circuit E to be controlled by the control portion C. The laser driving circuit D to be controlled in an operation through the control portion C outputs laser driving signals corresponding to image information about Y: yellow, M: magenta, C: cyan and K: black input from the image input device U1 to latent image forming devices ROSy, ROSm, ROSc and ROSk for the respective colors in a predetermined timing.

A pull-out member U3*b* for an image forming unit is supported below the latent image forming devices ROSy, ROSm, ROSc and ROSk for the respective colors so as to be movable between a pull-out position in which it is forward pulled out of the image forming apparatus body U3 and an attaching position in which it is attached into the image forming apparatus body U3 by means of a pair of left and right guiding members R1 and R1.

Figure 2:
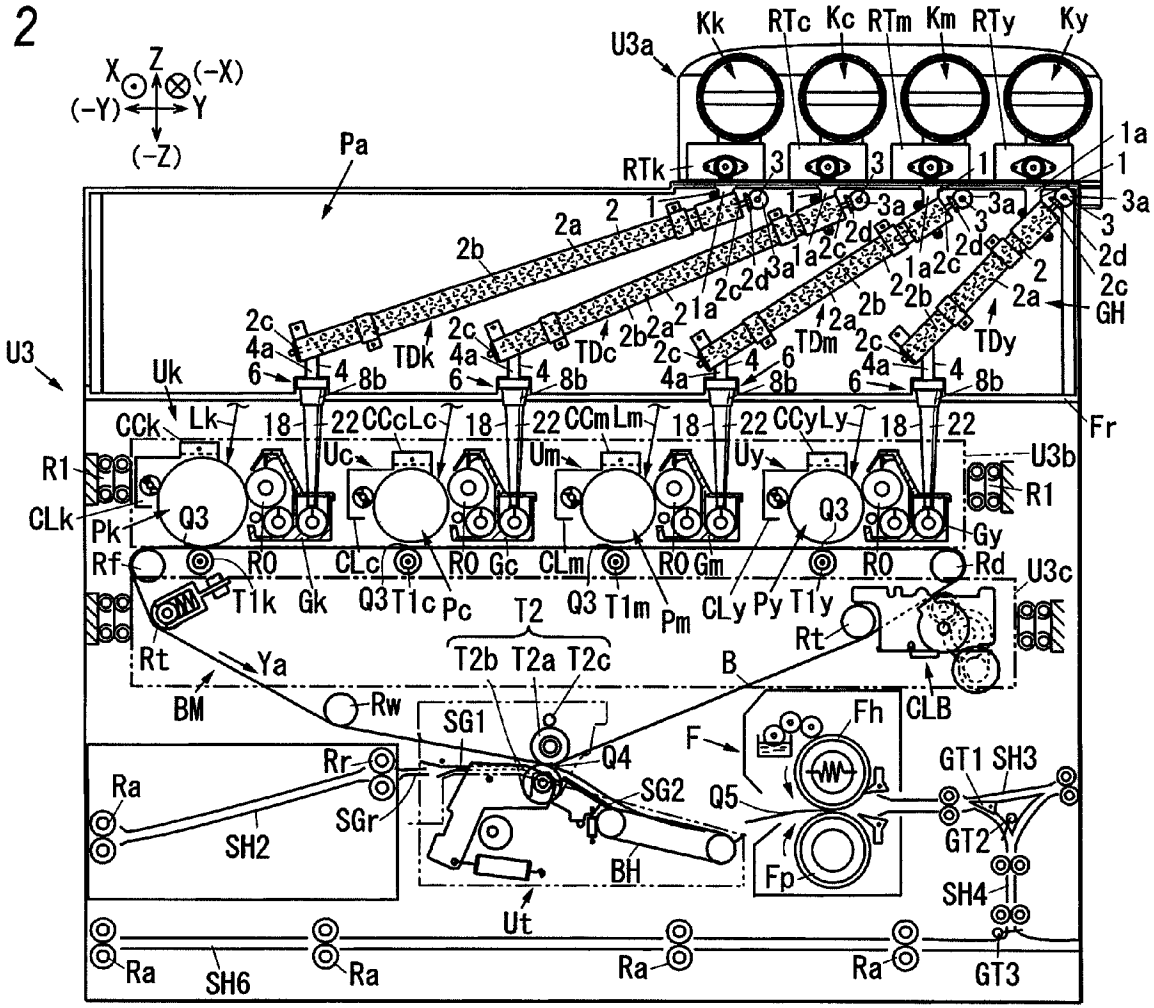
FIG. 2 is an explanatory view showing an image forming apparatus body and a toner dispenser device.

FIG. 2 is an explanatory view showing the image forming apparatus body and the toner dispenser device.

In FIGS. 1 and 2, an image carrier unit Uk for K: black has a photosensitive drum Pk according to an example of an image carrier, a charger CCk according to an example of a discharger, and a cleaner CLk according to an example of a cleaning device for an image carrier. In the first example, the cleaner CLk is constituted by a cleaner unit. Image holding member units Uy, Um and Uc for the other colors Y, M and C also have photosensitive drums Py, Pm and Pc, chargers CCy, CCm and CCc, and cleaners CLy, CLm and CLc, respectively. In the first example, the photosensitive drum Pk for the K color which is frequently used and has a surface worn greatly is constituted to have a larger diameter as compared with the photosensitive drums Py, Pm and Pc for the other colors, and is ready for a high-speed rotation and has a lifetime prolonged.

Toner image forming members Uy+Gy, Um+Gm, Uc+Gc, and Uk+Gk are constituted by the image carrier units Uy, Um, Uc and Uk and developing units Gy, Gm, Gc and Gk according to an example of a developing device having a developing roll R0. The image carrier units Uy, Urn, Uc and Uk and the developing units Gy, Gm, Gc and Gk are removably attached to the pull-out member U3*b* for the image forming unit.

The photosensitive drums Py, Pm, Pc and Pk are uniformly charged by the chargers CCy, CCm, CCc and CCk respectively, and electrostatic latent images are then formed on surfaces thereof through laser beams Ly, Lm, Lc and Lk according to an example of latent image writing lights output from the latent image forming devices ROSy, ROSm, ROSc and ROSk. The electrostatic latent images formed on the surfaces of the photosensitive drums Py, Pm, Pc and Pk are developed into toner images according to an example of visible images with toners according to an example of powders for the respective colors of Y: yellow, M: magenta, C: cyan and K: black by means of the developing units Gy, Gm, Gc and Gk.

The toner images on the surfaces of the photosensitive drums Py, Pm, Pc and Pk are sequentially superposed and transferred onto an intermediate transfer belt B according to an example of an intermediate transfer member in a primary transfer region Q3 by means of primary transfer rolls T1*y*, T1*m*, T1*c* and T1*k* according to an example of primary transfer units so that a multicolor image, that is, a color image is formed on the intermediate transfer belt B. The color image formed on the intermediate transfer belt B is transported to a secondary transfer region Q4.

In case of only black image data, only the photosensitive drum Pk and the developing unit Gk for the black color are used so that only a black toner image is formed.

After the primary transfer, the toners remaining on the surfaces of the photosensitive drums Py, Pm, Pc and Pk are cleaned by the cleaners CLy, CLm, CLc and CLk for the photosensitive drums.

In FIG. 2, the toner dispenser device U3*a* has toner dispensers TDy, TDm, TDc and TDk according to an example of powder supplying devices corresponding to the respective colors Y, M, C and K. Toner cartridges Ky, Km, Kc and Kk according to an example of powder housing containers are removably attached to the toner dispensers TDy to TDk, and the toner dispensers My to TDk supply powders in the toner cartridges Ky to Kk to the developing units Gy to Gk depending on a toner consumption of the developing units Gy to Gk.

A pull-out member U3*c* for an intermediate transfer member is supported below the pull-out member U3*b* for the image forming unit so as to be movable between a pull-out position in which it is forward pulled out of the image forming apparatus body U3 and an attaching position in which it is attached into the image forming apparatus body U3. A belt module BM according to an example of the intermediate transfer device is supported by the pull-out member U3*c* for the intermediate transfer member so as to be upward and downward movable between an upward moving position in which it comes in contact with lower surfaces of the photosensitive drums Py, Pm, Pc and Pk and a downward moving position in which it is separated downward from the lower surfaces.

The belt module BM has the intermediate transfer belt B, a belt support roll Rd+Rt+Rw+Rf+T2*a* according to an example of an intermediate transfer member support member, and the primary transfer rolls T1*y*, T1*m*, T1*c* and T1*k*. The belt support roll Rd+Rt+Rw+Rf+T2*a* has a belt driving roll Rd according to an example of an intermediate transfer member driving member, a tension roll Rt according to an example of a tension applying member, a walking roll Rw according to an example of a meander preventing member, plural of idler rolls Rf according to an example of a driven member, and a backup roll T2*a* according to an example of a secondary transfer opposing member. The intermediate transfer belt B is supported to be rotatable and movable in a direction of an arrow Ya by means of the belt support roll Rd+Rt+Rw+Rf+T2*a*.

A secondary transfer unit Ut is disposed below the backup roll T2*a*. A secondary transfer roll T2*b* according to an example of a secondary transfer member of the secondary transfer unit Ut is disposed to enable a separation/contact from/with the backup roll T2*a* in a state in which the intermediate transfer belt B is interposed therebetween, and the secondary transfer region Q4 is formed by a region in which the secondary transfer roll T2*b* comes in pressure contact with the intermediate transfer belt B. Moreover, a contact roll T2*c* according to an example of a voltage applying contact member abuts on the backup roll T2*a*, and a secondary transfer unit T2 is constituted by the rolls T2*a* to T2*c*.

A secondary transfer voltage having the same polarity as a charging polarity of the toner is applied to the contact roll T2*c* at a preset time from the power circuit to be controlled by the control portion C.

The paper transporting path SH2 is disposed below the belt module BM. The recording paper S fed from the paper feeding path SH1 of the paper feeding device U2 is transported to the paper transporting path SH2 and is transported to the secondary transfer region Q4 via a medium guiding member SGr and a pre-transfer medium guiding member SG1 corresponding to a time that a toner image is transported to the secondary transfer region Q4 by means of a resist roll Rr according to an example of a paper feeding time regulating member.

The medium guiding member SGr is fixed to the image forming apparatus body U3 together with the resist roll Rr.

The toner image on the intermediate transfer belt B is transferred onto the recording paper S by means of the secondary transfer unit T2 in a passage through the secondary transfer region Q4. In case of a color image, toner images superposed and transferred primarily onto the surface of the intermediate transfer belt B are secondarily transferred onto the recording paper S in a lump.

The intermediate transfer belt B subjected to the secondary transfer is cleaned by a belt cleaner CLB according to an example of an intermediate transfer member cleaning device. The secondary transfer roll T2*b* and the belt cleaner CLB are supported to enable a separation/contact from/with the intermediate transfer belt B.

A transfer device T1+B+T2+CLB for transferring images on the surfaces of the photosensitive drums Py to Pk onto the recording paper S is constituted by the primary transfer rolls T1*y*, T1*m*, T1*c* and T1*k*, the intermediate transfer belt B, the secondary transfer unit T2, and the belt cleaner CLB.

The recording paper S having the toner image transferred secondarily is transported to a fixing device F via a post-transfer medium guiding member SG2 and a paper transporting belt BH according to an example of a pre-fixing medium transporting member. The fixing device F has a heating roll Fh according to an example of a heating and fixing member and a pressurizing roll Fp according to an example of a pressurizing and fixing member, and a fixing region Q5 is formed by a region in which the heating roll Fh and the pressurizing roll Fp come in pressure contact with each other.

In a passage through the fixing region Q5, the toner image on the recording paper S is heated and fixed by the fixing device F. A transporting path switching member GT1 is provided on a downstream side of the fixing device F. The transporting path switching member GT1 selectively switches the recording paper S transported through the paper transporting path SH2 and heated and fixed by the fixing region Q5 into either the paper discharging path SH3 or the paper inverting path SH4 at the paper processing device U4 side. The recording paper S sent to the paper discharging path SH3 is transported to a paper transporting path SH5 of the paper processing device U4.

In FIG. 1, a curl correcting device U4*a* according to an example of a curve correcting device is disposed in the middle of the paper transporting path SH5, and a switching gate G4 according to an example of a transporting path switching member is disposed on the paper transporting path SH5. The switching gate G4 transports the recording paper S sent through the paper transporting path SH3 of the image forming apparatus body U3 to a side of a first curl correcting member h1 or a second curl correcting member h2 depending on a direction of a curve, that is, a curl. A curl of the recording paper S transported to the first curl correcting member h1 or the second curl correcting member h2 is corrected in the passage. The recording paper S having the curl corrected is discharged from a discharging roll Rh according to an example of a discharging member to a discharging tray TRh according to an example of a discharging portion of the paper processing device U4 in a state in which an image fixing surface of the recording paper S is turned upward, that is, a face-up state.

The recording paper S transported to the paper inverting path SH4 of the image forming apparatus body U3 through the transporting path switching member GT1 passes to push away a transporting direction controlling member constituted by an elastic thin film-shaped member, that is, a Mylar gate GT2 and is thus transported to the paper inverting path SH4 of the image forming apparatus body U3.

The paper circulating path SH6 and a paper inverting path SH7 are connected to a downstream end of the paper inverting path SH4 of the image forming apparatus body U3, and a Mylar gate GT3 is also disposed in a connecting portion thereof. The paper transported to the paper inverting path SH4 through the switching gate GT1 passes through the Mylar gate GT3 and is thus transported to the paper inverting path SH7 side of the paper processing device U4. In the case in which perfecting is carried out, the transporting direction is controlled by the Mylar gate GT3 and the recording paper S switched back is transported to the paper circulating path SH6 side when the recording paper S transported through the paper inverting path SH4 once passes through the Mylar gate GT3 exactly and is thus transported to the paper inverting path SH7, and is then transported in a reverse direction, that is, is switched back. The recording paper S transported to the paper circulating path SH6 is retransmitted to the transfer region Q4 via the paper feeding path SH1.

On the other hand, when the recording paper S transported through the paper inverting path SH4 is switched back after a rear end of the recording paper S passes through the Mylar gate GT2 and before it passes through the Mylar gate GT3, the transporting direction of the recording paper S is controlled by the Mylar gate GT2 and the recording paper S is transported to the paper transporting path SH5 with both sides inverted. A curl of the recording paper S having the both sides inverted is corrected by the curl correcting member U4*a* and the recording paper S can be then discharged to the paper discharging tray TRh of the paper processing device U4 in a state in which the image fixing surface of the recording paper S is turned downward, that is, a face-down state.

A paper transporting path SH is constituted by the elements indicated as the designations SH1 to SH7. Moreover, a paper transporting device SU is constituted by the elements indicated as the designations SH, Ra, Rr, Rh, SGr, SG1, SG2, BH, and GT1 to GT3.

(Explanation of Developer Supplying Device)

Figure 3:
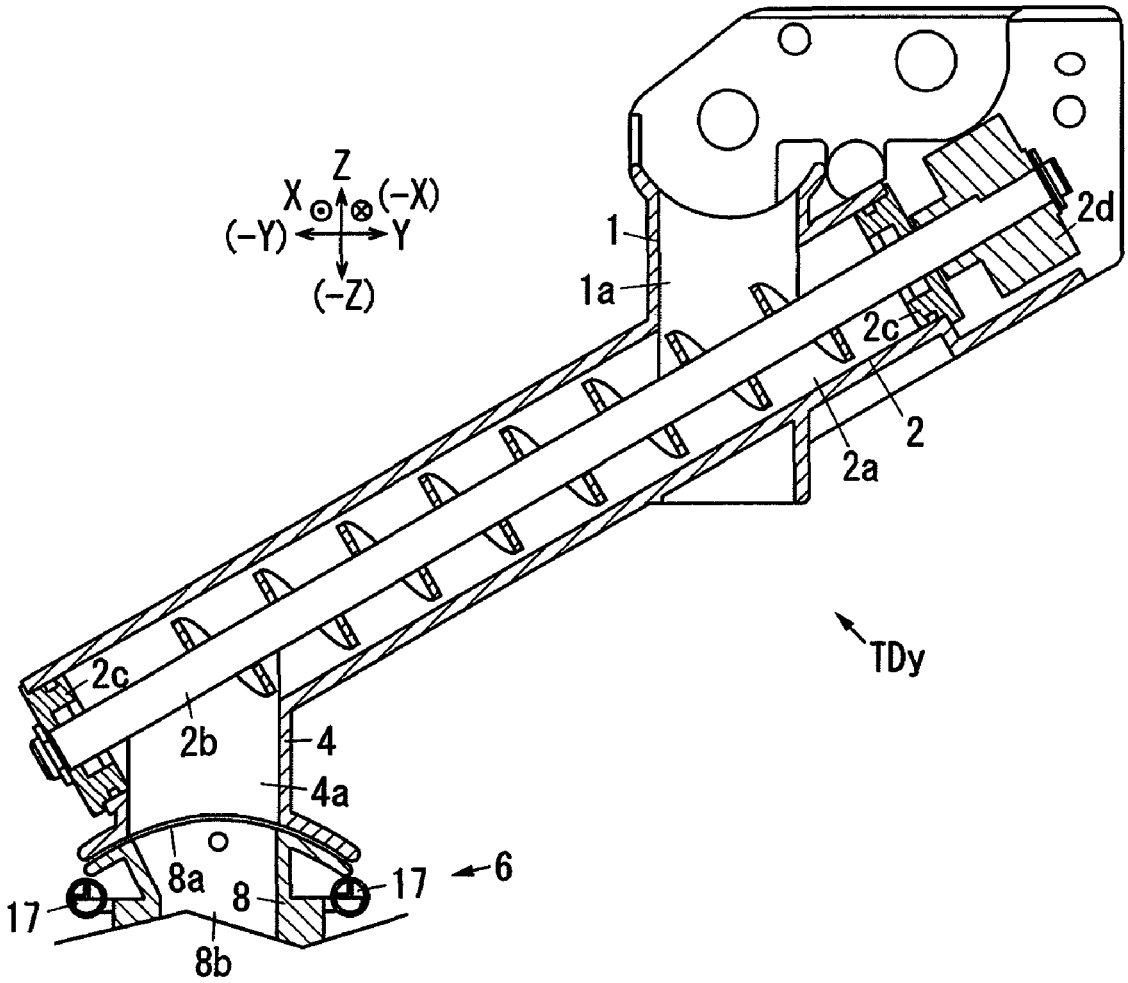
FIG. 3 is a sectional view showing a powder supplying device.

FIG. 3 is a sectional view showing the powder supplying device.

In FIG. 2, the toner dispenser TDy according to the first example has a reserve tank RTy according to an example of a storing and transporting container into which the powder of the toner cartridge Ky flows and in which the powder is stored temporarily and stirred.

In FIG. 3, a communicating and transporting cylinder 1 extended downward is connected to a lower surface of the reserve tank RTy, and a communicating and transporting path 1*a* is formed in the communicating and transporting cylinder 1. The powder flowing from the reserve tank RTy is transported through the communicating and transporting path 1*a*.

An inclined transporting cylinder 2 extended leftward, obliquely and downward is connected to a lower end of the communicating and transporting cylinder 1, and an inclined transporting path 2*a* is formed in the inclined transporting cylinder 2. A lower end of the communicating and transporting path 1*a* is connected to the inclined transporting path 2*a*.

An auger 2*b* extended along the inclined transporting path 2*a* according to an example of a transporting member is disposed in the inclined transporting path 2*a*. Both upper and lower ends of the auger 2*b* are rotatably supported by bearing members 2*c* supported on both upper and lower ends of the inclined transporting path 2*a*. The upper end of the auger 2*b* penetrates upward from the upper end of the inclined transporting path 2*a*, and a passive gear 2*d* according to an example of a passive toothed wheel is supported on the upper end of the auger 2*b*. The passive gear 2*d* is engaged with a transmission gear 3*a* according to an example of a driving transmission toothed wheel which is supported on a driving rotary shaft 3 extended from the image forming apparatus body U3 side.

An upper transporting cylinder 4 extended downward is connected to the lower end of the inclined transporting cylinder 2. An upper transporting path 4*a* according to an example of a first transporting path to be connected to the lower end of the inclined transporting path 2*a* is formed in the upper transporting cylinder 4. A connecting member 6 is supported on a lower end of the upper transporting cylinder 4.

Figure 4:
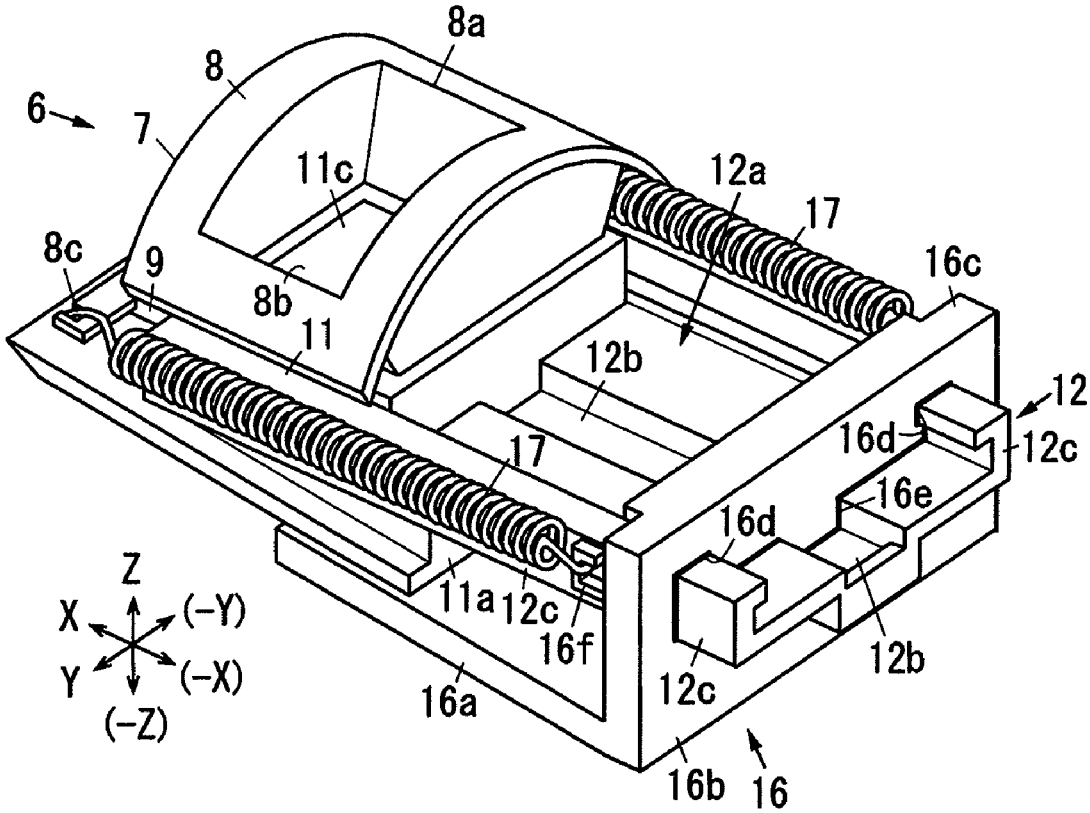
FIG. 4 is a perspective view for explaining a connecting member.

FIG. 4 is a perspective view for explaining the connecting member.

Figure 5:
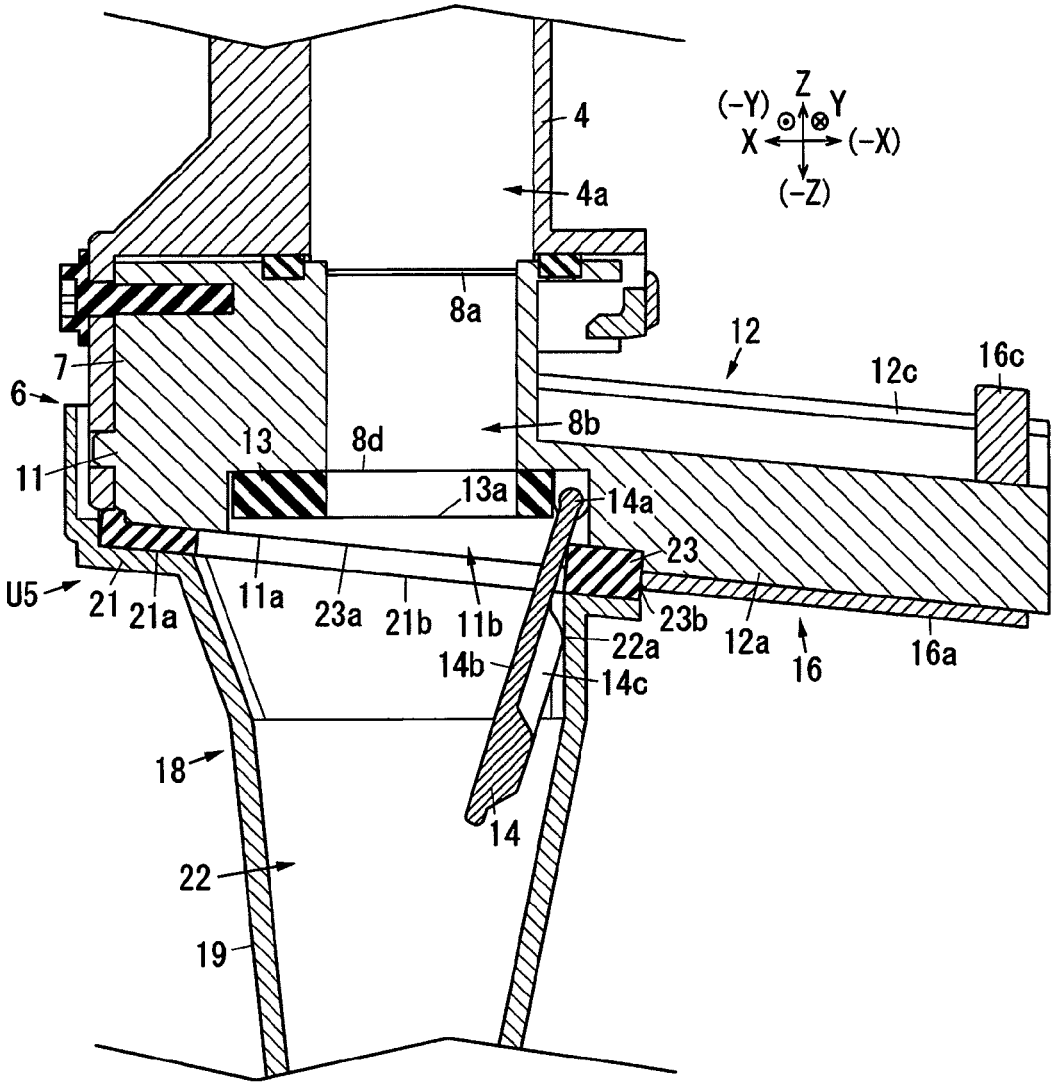
FIG. 5 is a sectional view for explaining a state in which the connecting member and a lower transporting member are connected to each other.

FIG. 5 is a sectional view for explaining a state in which the connecting member and a lower transporting member are connected to each other.

In FIGS. 3 and 4, the connecting member 6 has a connecting frame 7 extended in a vertical direction according to an example of a connecting member frame body. An upper connecting portion 8 bulged like a convex part and taking a shape of an arcuate surface is formed on an upper end of the connecting frame 7. An upper connecting port 8*a* serving as a square opening to be connected to the upper transporting path 4*a* is formed on a central part of the upper connecting portion 8, and a connection transporting path 8*b* extended downward is formed therein. A pair of left and right spring support portions 8*c* taking an overhung shape toward both left and right sides according to an example of an energizing member support portion is formed on a front end of the upper connecting portion 8.

In FIGS. 4 and 5, a lower connecting portion 9 is formed on a lower end of the upper connecting portion 8. The lower connecting portion 9 has a connecting portion body 11 on a front side and a guiding portion 12 on a rear side.

The connecting portion body 11 is formed to take a shape of a prism extended in the vertical direction, and a lower contact surface 11*a* is formed on a lower end of the connecting portion body 11. The lower contact surface 11*a* is inclined rearward and downward.

Moreover, a rotating shutter housing portion 11*b* is formed in the connecting portion body 11. The rotating shutter housing portion 11*b* takes an upward concave shape from the lower end.

The connection transporting path 8*b* is connected to the rotating shutter housing portion 11*b*, and the rotating shutter housing portion 11*b* has a larger area than a discharging port 8*d* serving as an opening formed on the lower end of the connection transporting path 8*b*.

The guiding portion 12 has a plate-shaped guiding portion body 12*a* which is extended rearward from a rear end in a central part in the vertical direction of the connecting portion body 11. A first guide groove 12*b* is formed on a central part in a transverse direction of an upper surface of the guiding portion body 12*a*. The first guide groove 12*b* is extended in a longitudinal direction and takes a concave shape according to an example of a first open/close guiding portion.

A pair of left and right guide rails 12*c* is disposed on both left and right ends of the guiding portion body 12*a*. The guide rail 12*c* has an upper end curved inward in the transverse direction and is extended in the longitudinal direction according to an example of a second open/close guiding portion.

In FIG. 5, a sponge seal 13 is fixed and supported on an edge part of the discharging port 8*d*. The sponge seal 13 is formed by an elastic member according to an example of an opening sealing member. A seal opening 13*a* is formed on a central part of the sponge seal 13. The seal opening 13*a* is opened to take a square shape corresponding to the discharging port 8*d* according to an example of an elastic member opening.

An inner shutter 14 is supported on a rear end of the shutter housing portion 11*b* rotatably around a rotating center 14*a* according to an example of a rotation gate member. The inner shutter 14 has a plate-shaped inner shutter body 14*b* according to an example of a rotation gate member body. In the state shown in FIG. 5, plural of stripe-shaped ribs 14*c* protruded downward and extended in the longitudinal direction is formed on a bottom face of the inner shutter body 14*b* according to an example of a contact portion.

A slide shutter 16 is supported on the guiding portion body 12*a* according to an example of an outer gate member. The slide shutter 16 is movable in the longitudinal direction. The slide shutter 16 has a plate-shaped slide shutter body 16*a* disposed below the guiding portion body 12*a*.

A frame-shaped coupling portion 16*b* surrounding the guiding portion body 12*a* is integrally formed on a rear end of the slide shutter body 16*a*. The coupling portion 16*b* has a guide bar 16*c* extended in a transverse direction above the guiding portion body 12*a* according to an example of a guided member.

The guide bar 16*c* has a pair of left and right guided concave portions 16*d* according to an example of a second guided portion and a guided and protruded portion 16*e* according to an example of a first guided portion which are formed thereon. The guided concave portion 16*d* is fitted in the guiding portion body 12*c* and is thus guided movably in the longitudinal direction. The guided and protruded portion 16*e* is fitted in the first guide groove 12*b* and is thus guided movably in the longitudinal direction.

Moreover, a pair of left and right spring support portions 16*f* on a guide side is formed according to an example of an energizing support portion in positions corresponding to the spring support portions 8*c* at both left and right ends of the guide bar 16*c*. A pair of left and right tension springs 17 extended in the longitudinal direction is coupled according to an example of an energizing member between the spring support portions 16*f* on the guide side and the spring support portions 8*c*. The tension spring 17 energizes the guide bar 16 forward.

In FIG. 5, a lower transporting member 18 is disposed below the lower connecting portion 9. The lower transporting member 18 has a lower transporting cylinder 19 extended in a vertical direction and taking a cylindrical shape, and a connected portion 21 is formed on an upper end of the lower transporting cylinder 19.

Moreover, a lower transporting path 22 is formed according to an example of a second transporting path in the lower transporting cylinder 19. The lower transporting path 22 has a lower end connected to the developing unit Gy and an upper end connected to the connection transporting path 8*b*.

A powder supplying path GH is constituted according to an example of a transporting path by the elements indicated as the designations 1*a*, 2*a*, 4*a*, 8*b* and 22.

The connected portion 21 has a connected surface 21*a* which is inclined upward in a forward direction corresponding to the lower contact surface 11*a*, and has a structure in which the connecting portion body 11 can be accommodated into the connected portion 21 from a rear part. A rectangular transporty-in port 21*b* is formed on a central part of the connected surface 21*a*. The transporty-in port 21*b* is extended in the longitudinal direction corresponding to the shutter housing portion 11*b*.

A sponge seal 23 formed by an elastic member according to an example of a sealing member is fixedly supported on an edge part of the transporty-in port 21*b*. A lower seal port 23*a* is formed according to an example of an opening on a central part of the lower sponge seal 23. The lower seal port 23*a* is extended in the longitudinal direction corresponding to the transporty-in port 21*b* and is opened to take a rectangular shape.

In FIG. 5, a height of the lower sponge seal 23 according to the first example is set to be greater than that of the lower contact surface 11*a*. In the case in which the connected portion 21 of the lower transporting portion 18 and the connecting member body 11 are connected to each other, the lower sponge seal 23 is elastically deformed to seal a clearance between the connected portion 21 and the connecting portion body 11.

Accordingly, a height of the slide shutter body 16*a* of the slide shutter 16 is set in such a manner that a front end comes in contact with a rear end face 23*b* of the lower sponge seal 23.

As shown in FIG. 5, consequently, the front end of the slide shutter body 16*a* comes in contact with the rear end face 23*b* and is thus shifted rearward against the tension spring 17 in a state in which the connected portion 21 and the connecting member body 11 are connected to each other. Thus, the slide shutter body 16*a* is held in an outer opening position in which a lower surface of the shutter housing portion 11*b* is opened.

At this time, the inner shutter body 14*b* is rotated around the rotating center 14*a* by an action of a gravity and thus enters an inner part of the lower transporting path 22, and is held in a rotation opening position in which the rib 14*c* comes in contact with an internal wall rear surface 22*a* of the lower transporting path 22.

Figure 6:
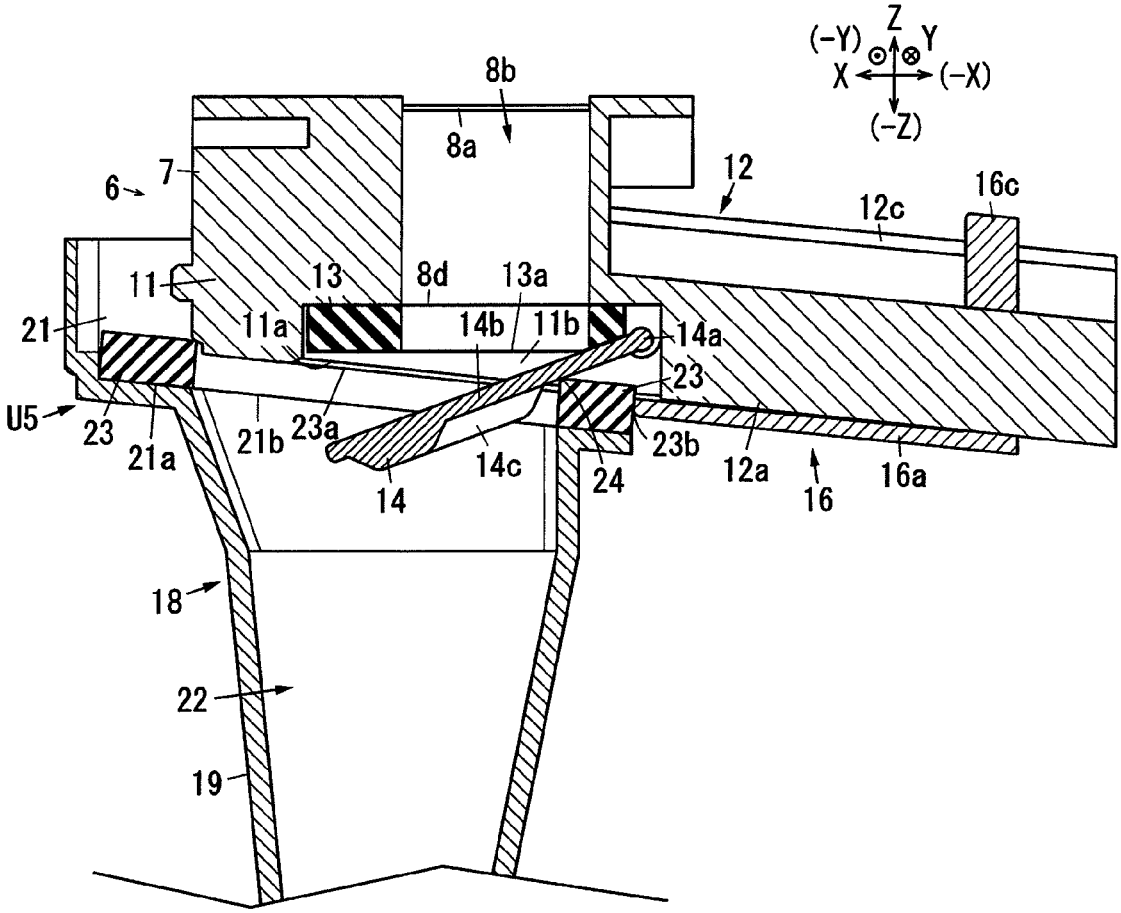
FIG. 6 is an explanatory view showing a state in which the lower transporting member is shifted forward in the state illustrated in FIG. 5.

FIG. 6 is an explanatory view showing a state in which the lower transporting member is shifted forward in the state illustrated in FIG. 5.

Figure 7:
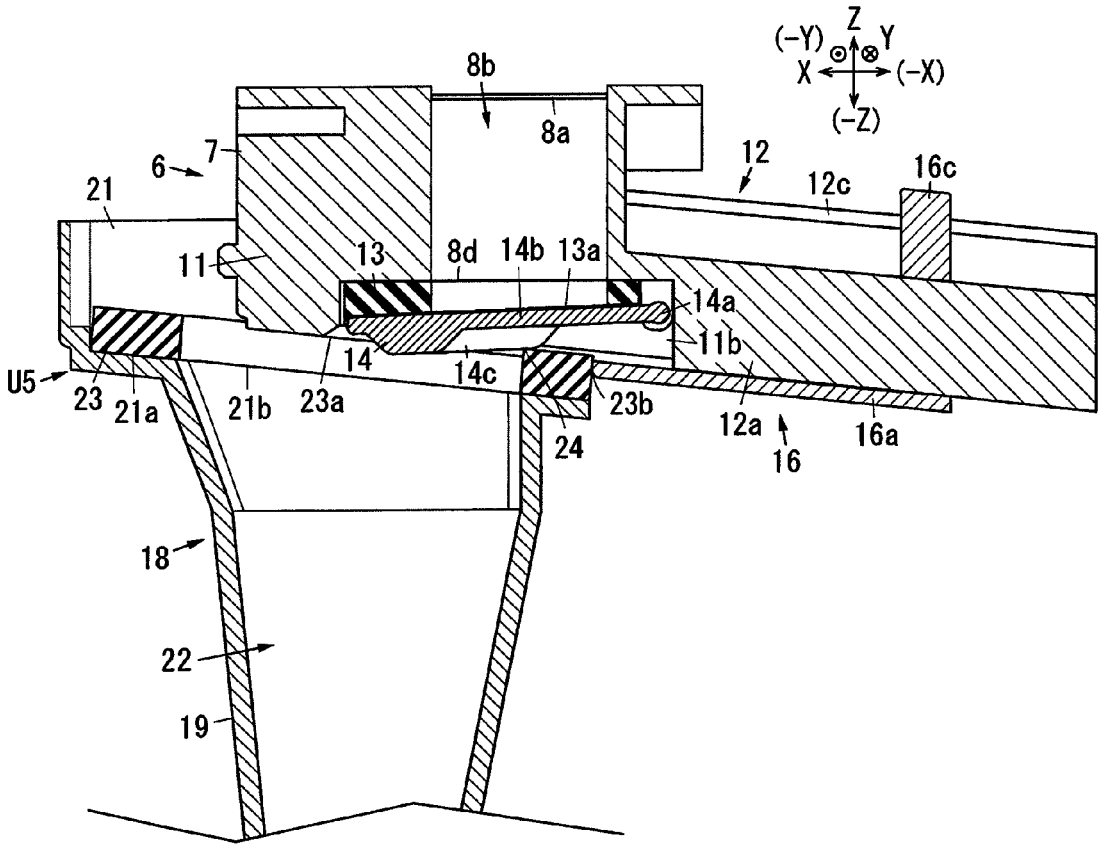
FIG. 7 is an explanatory view showing a state in which the lower transporting member is shifted further forward in the state illustrated in FIG. 6.

FIG. 7 is an explanatory view showing a state in which the lower transporting member is shifted further forward in the state illustrated in FIG. 6.

Figure 8:
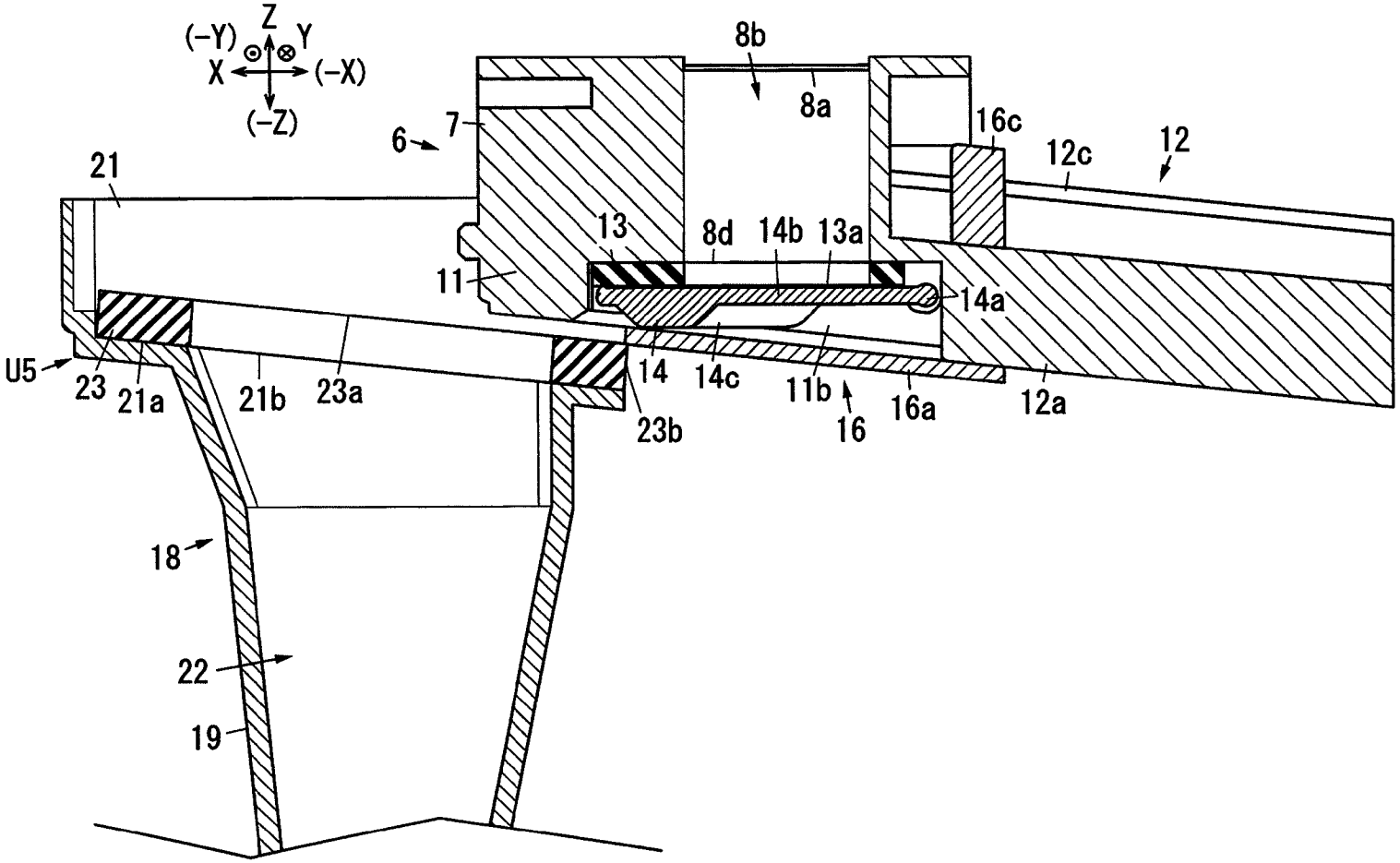
FIG. 8 is an explanatory view showing a state in which the lower transporting member is removed from the connecting member.

FIG. 8 is an explanatory view showing a state in which the lower transporting member is removed from the connecting member.

In order to exchange the developing unit Gy in the state in which the connecting member body 11 and the connected portion 21 according to the first example shown in FIG. 5 are connected to each other, when the lower transporting member 18 is shifted forward from the connecting member body 11 as shown in FIG. 6, a contact portion 24 on a rear side inner edge of the lower seal port 23*a* is forward moved while upward pushing a bottom face of the inner shutter body 14*b* with which the contact portion 24 comes in contact.

Moreover, the slide shutter body 16*a* is energized forward by means of the tension spring 17 and is forward moved while maintaining a state in which the front end comes in contact with the rear end face 23*b* according to the forward movement of the lower transporting member 18.

When the lower transporting member 18 is moved further forward as compared with the state shown in FIG. 6, the inner shutter body 14*b* is rotated further upward so that an upper surface of the inner shutter body 14*b* comes in contact with the sponge seal 13 as shown in FIG. 7 and the sponge seal 13 is thus deformed elastically.

When the lower transporting member 18 is moved further forward in the state shown in FIG. 7, then, the contact portion 24 is moved forward while coming in contact with the rib 14*c* of the inner shutter 14 so that the inner shutter 14 is pushed against the sponge seal 13 and the discharging port 8*d* and the seal opening 13*a* are thus sealed.

At this time, the slide shutter 16 is moved forward while the front end comes in contact with the rear end face 23*b* of the lower sponge seal 23 by an energizing force of the tension spring 17, and enters a part provided below the rib 14*c* after the contact of the contact portion 24.

When the lower transporting member 18 forward comes out of the shutter housing portion 11*b* as shown in FIG. 8, then, the inner shutter 14 is pushed against the sponge seal 13 in a state in which the slide shutter 16 comes in contact with the rib 14*c*, and furthermore, the slide shutter 16 is moved to an outer blocking position in which a lower surface of the shutter housing portion 11*b* is blocked.

Accordingly, the transporting member 18 is removed forward in the state in which the lower surface of the shutter housing portion 11*b* is blocked with the slide shutter 16.

In the case in which the lower transporting member 18 is attached, the rear end face 23*b* of the lower sponge seal 23 pushes the front end of the slide shutter 16 to move the slide shutter 16 to the outer opening position shown in FIG. 5 against the energizing force of the tension spring 17 when the lower transporting member 18 is moved rearward.

When the slide shutter 16 is moved rearward, there is no member for supporting the part provided below the inner shutter 14 so that the inner shutter 14 is rotated downward by an elastic restoration and a gravity of the sponge seal 13 and is thus moved to the rotation opening position.

Therefore, the upper transporting path 4*a* and the lower transporting path 22 are constituted removably through the connecting member 6. In the first example, the upper transporting path 4*a* and the lower transporting path 22 are constituted removably in a longitudinal direction to be a direction crossing the vertical direction in which the powder is transported through the powder supplying path GH.

Moreover, a powder transporting device U5 is constituted by members indicated as the designations 4 to 24.

Function of First Example

In the image forming apparatus U according to the first example which has the structure described above, when the image forming operation, that is, the job is executed so that the powder is consumed by each of the developing units Gy to Gk, the toner dispenser device U3*a* is operated depending on an amount of the consumption so that the powder is supplied from each of the toner cartridges Ky to Kk.

In FIG. 2, in the case in which the developing units Gy to Gk are forward pulled out of the image forming apparatus body U3 in a maintenance work such as a repair, an inspection or a component exchange, the pull-out member U3*b* for the image forming unit is guided by the guiding members R1 and R1 and is thus moved from the attaching position toward the pull-out position. Consequently, the lower transporting member 18 connected to the developing unit Gy is moved forward with respect to the connecting member body 11 of the connecting member 6.

With the forward movement of the lower transporting member 18, the bottom face of the inner shutter 14 comes in contact with the contact portion 24 of the rear side inner edge of the lower seal port 23*a* in the rotation opening position and is thus rotated upward as shown in FIGS. 5 and 6. As shown in FIG. 6, then, the inner shutter 14 comes in contact with the sponge seal 13 from below to elastically deform the sponge seal 13.

When the lower transporting member 18 is moved further forward in the state shown in FIG. 6, the rib 14*c* comes in contact with the contact portion 24 as shown in FIG. 7. When the lower transporting member 18 is moved forward in this state, the contact portion 24 is moved forward while coming in contact with the rib 14*c* on the bottom face of the inner shutter 14. Accordingly, the contact portion 24 is moved while wiping the bottom face of the inner shutter 14 so that the powder sticking to the bottom face of the inner shutter 14 is wiped.

In the first example, at this time, an elastic restoring force of the sponge seal 13 acts and a force for pushing the rib 14*c* against the contact portion 24 acts. Therefore, the rib 14*c* is wiped more stably as compared with the case in which the rib 14*c* is not provided and the sponge seal 13 has a small elastic restoring force or no elastic restoring force, for example.

When the lower transporting member 18 is moved further forward in the state shown in FIG. 7, moreover, it forward comes out with respect to the shutter housing portion 11*b* and is thus removed from the connecting member 6 as shown in FIG. 8. At this time, the slide shutter 16 enters the part provided below the rib 14*c* having the bottom face wiped by the contact portion 24 through the energizing force of the tension spring 17.

Subsequently, the slide shutter 16 on which the energizing force of the tension spring 17 acts pushes the rib 14*c* upward to move the inner shutter 14 to the rotation blocking position, and is thus moved to the outer blocking position.

Accordingly, the slide shutter 16 moved to the outer blocking position holds the inner shutter 14 pushed against the sponge seal 13 so that the seal opening 13*a* is blocked in a sealing state.

In the case in which the pull-out member U3*b* for the image forming unit is moved from the pull-out position to the attaching position so that the lower transporting member 18 is attached to the connecting member 6, furthermore, the slide shutter 16 is pushed by the rear end face 23*b* of the sponge seal 23 and is thus moved from the outer blocking position to the outer opening position.

Therefore, the slide shutter 16 according to the first example is disposed on the outside of the upper transporting path 4*a* and the lower transporting path 22 in contact with the rear end face 23*b* in the outer opening position. Consequently, it is possible to reduce the scatter of the powder more greatly as compared with the case in which the tip of the sliding type gate plate (7) enters the inner part of the opening (91) in the opening state and the powder might be scattered from or might leak out of the clearance as described in JP-A-2000-221766.

In the first example, moreover, the bottom face of the inner shutter 14 is wiped by the contact portion 24 and then comes in contact with the slide shutter 16 in the outer blocking position. Accordingly, it is possible to reduce the scatter of the powder more greatly as compared with the case in which the front end of the sliding type gate plate (7) is closed while wiping the lower surface of the oscillating type gate plate (6) and the powder wiped by the tip of the sliding type gate plate (7) might be dropped or scattered as described in JP-A-2000-221766.

In contrast to the conventional structure in which the powder scattered from the clearance might be deposited on the upper surface of the sliding type gate plate (7) and might fall in the movement of the sliding type gate plate (7), furthermore, the powder is not deposited on the upper surface of the slide shutter 16 in the outer opening position and can be prevented from falling to contaminate the inner part of the image forming apparatus body U3 in the first example.

In the first example, the slide shutter 16 comes in contact with the rib 14*c* on the lower surface of the inner shutter 14 in the movement thereof. As compared with the case in which the rib 14*c* is not provided as in JP-A-2000-221766, therefore, a contact area of the slide shutter 16 and the inner shutter 14 can be reduced more greatly so that a frictional resistance can be decreased more highly. Therefore, a resistance can be reduced in the movement of the slide shutter 16 between the outer blocking position and the outer opening position, and the slide shutter 16 is thus moved stably between the outer blocking position and the outer opening position.

(Variant)

Although the example according to the invention has been described above in detail, the invention is not restricted to the example but various changes can be made without departing from the present invention. Variants (H01) to (H07) according to the invention will be described below.

(H01) Although the image forming apparatus U has been illustrated in the example, the invention is not restricted thereto but can be applied to a copying machine, a FAX or a compound machine having plural of functions. Moreover, the invention is not restricted to an image forming apparatus for multicolor development but can also be applied to an image forming apparatus for a single color, that is, a monochrome. The invention is not restricted to an image forming apparatus of a so-called tandem type but can also be applied to an image forming apparatus of a rotary type.

(H02) Although there has been illustrated the structure of the connecting portion of the upper transporting path 4*a* and the lower transporting path 22 in each of the toner dispensers TDy to TDk for supplying the powder to each of the developing units Gy to Gk in the example, the invention is not restricted thereto but can be applied to a transporting path for transporting a powder other than the powders of the toner dispensers TDy to TDk. For instance, the invention can be applied to a transporting path for transporting substances collected by the cleaners CLy to CLk and the belt cleaner CLB. In the case in which the developing units Gy to Gk are mechanisms for discharging the deteriorated powder, moreover, the invention can be applied to a transporting path for transporting the discharged powder.

(H03) Although there has been illustrated the structure in which the stripe-shaped rib 14*c* is provided on the bottom face of the inner shutter 14 in the example, the invention is not restricted thereto but an optional shape can also be taken and it is also possible to provide a protruded portion which is protruded downward from the bottom face, for instance. Although the structure having the rib 14*c* is desirable, moreover, it is also possible to employ a structure in which the rib 14*c* is omitted.

(H04) Although there is illustrated the structure in which the lower transporting path 22 is moved in the longitudinal direction with respect to the upper transporting path 4*a* which is fixed, and is thus attached to and removed from the upper transporting path 4*a* in the example, the invention is not restricted thereto but it is also possible to employ a structure in which the upper transporting path 4*a* is moved in the longitudinal direction with respect to the lower transporting path 22 which is fixed, and is thus attached to and removed from the lower transporting path 22.

(H05) Although there is illustrated the structure in which the inner shutter 14 is moved from the rotation blocking position to the rotation opening position by the action of the gravity in the example, the invention is not restricted thereto but it is also possible to employ a structure in which the inner shutter 14 is rotated and moved to the rotation opening position by means of a spring to be an energizing member.

(H06) Although there is illustrated the structure in which the upper transporting path 4*a* and the lower transporting path 22 which are extended in the vertical direction are disposed in the example, the invention is not restricted thereto but it is also possible to dispose a transporting path extended in an optional direction, for instance, a transporting path extended in a transverse and horizontal direction or a transporting path extended in an oblique direction.

(H07) Although there is illustrated the paper processing device U4 provided with the curl correcting device U4*a* in the example, the invention is not restricted thereto but it is also possible to employ an optional structure, for instance, to provide, in the paper processing device U4, an end stitching device (7 to 18) and a saddle stitching device (21 to 26) according to JP-A-2007-070124, to omit the curl correcting device U4*a* from the paper processing device U4 and to omit the paper processing device U4 from the image forming apparatus U.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A powder transporting device comprising:

a transporting path that has a first transporting path in which a powder is transported and a second transporting path connected to the first transporting path, the first transporting path and the second transporting path being relatively removable;

a connecting member that is disposed in a connecting portion of the first transporting path and the second transporting path so as to be supported on one of the first transporting path and the second transporting path;

a sealing member that is supported on an end of a connection transporting path on the other of the first transporting path and the second transporting path which is connected to the connecting member and that seals the connection transporting path and the connecting member when the connection transporting path and the connecting member are connected to each other;

an opening that is disposed on an end side of the connection transporting path of the connecting member;

a rotation gate member that is supported rotatably around a rotating center disposed on a side of the sealing member of the opening and that moves between (i) a rotation blocking position in which the opening is blocked and (ii) a rotation opening position in which the opening is opened and which is inclined toward an inner part side of the connection transporting path;

an outer gate member that is disposed on an outside of the rotation gate member moved to the rotation blocking position so as to be supported on the connecting member movably in a direction along the opening and;

wherein the sealing member moves the rotation gate member from the rotation opening position to the rotation blocking position while contacting an external surface of the rotation gate member when the connection transporting path is moved in a separating direction from the connecting member, and the outer gate member moves between (iii) an outer opening position in which an outside of the rotation gate member is opened in contact with the sealing member when the connection transporting path and the connecting member are connected to each other and (iv) an outer blocking position in which the outside of the rotation gate member is blocked when the connection transporting path is separated from the connecting member.

2. The powder transporting device according to claim 1 further comprising:

an opening sealing member that is supported on the rotation gate member side of the opening and that seals from the rotation gate member through an elastic deformation when the rotation gate member is moved to the rotation blocking position;

wherein the rotation gate member elastically deforms the opening sealing member in contact of an internal surface with the opening sealing member when an external surface comes in contact with the sealing member.

3. The powder transporting device according to claim 2 further comprising:

a concavo-convex contact portion that is provided on the external surface of the rotation gate member and that contacts the sealing member when the connection transporting path is separated from the connecting member.

4. An image forming apparatus comprising:

an image carrier that has a surface on which a latent image is to be formed;

a developing device that develops the latent image on the surface of the image carrier into a visible image;

a transfer device that transfers the developed visible image onto a medium;

a fixing device that fixes the transferred visible image onto the medium; and a powder transporting device according to claim 2 that is provided in a transporting path to transports a powder.

5. The powder transporting device according to claim 1 further comprising:

a concavo-convex contact portion that is provided on the external surface of the rotation gate member and that contacts the sealing member when the connection transporting path is separated from the connecting member.

6. An image forming apparatus comprising:

an image carrier that has a surface on which a latent image is to be formed;

a developing device that develops the latent image on the surface of the image carrier into a visible image;

a transfer device that transfers the developed visible image onto a medium;

a fixing device that fixes the transferred visible image onto the medium; and a powder transporting device according to claim 1 that is provided in a transporting path to transports a powder.

* * * * *